US011103977B2

(12) United States Patent
Ishii et al.

(10) Patent No.: US 11,103,977 B2
(45) Date of Patent: Aug. 31, 2021

(54) CLAMPING DEVICE

(71) Applicant: SMC CORPORATION, Chiyoda-ku (JP)

(72) Inventors: Mikihito Ishii, Moriya (JP); Toshikazu Nakajima, Toride (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/763,057

(22) PCT Filed: Nov. 7, 2018

(86) PCT No.: PCT/JP2018/041268
§ 371 (c)(1),
(2) Date: May 11, 2020

(87) PCT Pub. No.: WO2019/098099
PCT Pub. Date: May 23, 2019

(65) Prior Publication Data

US 2020/0346324 A1 Nov. 5, 2020

(30) Foreign Application Priority Data

Nov. 14, 2017 (JP) ..... JP2017-218853

(51) Int. Cl.
*B25B 5/06* (2006.01)
*B25B 5/16* (2006.01)

(52) U.S. Cl.
CPC ..... *B25B 5/064* (2013.01); *B25B 5/16* (2013.01)

(58) Field of Classification Search
CPC .. B25B 5/087; B25B 5/08; B25B 5/16; B25B 5/163; B25B 5/064; B25B 5/061;
(Continued)

(56) References Cited

U.S. PATENT DOCUMENTS 7,584,946 B2 * 9/2009 Doi ..... B25B 5/06 269/225
8,132,801 B2 * 3/2012 Miyashita ..... B25B 5/087 269/49

(Continued)

FOREIGN PATENT DOCUMENTS

DE 10 2016 203 353 A1 9/2017
EP 1 500 470 A1 1/2005

(Continued)

OTHER PUBLICATIONS

International Search Report and Written Opinion dated Feb. 21, 2019 in PCT/JP2018/041268 filed Nov. 7, 2018.

(Continued)

*Primary Examiner* — Orlando E Aviles
*Assistant Examiner* — Robert F Neibaur
(74) *Attorney, Agent, or Firm* — Oblon, McClelland, Maier & Neustadt, L.L.P.

(57) ABSTRACT

A clamping device has a clamp arm pivotally housed inside a body, and a locating section for positioning workpieces is provided on an upper portion of the body. The locating section is formed with a slit hole which enables a claw portion of the clamp arm to protrude outside, and is provided inside with a shutter facing the slit hole and being movable. The claw portion of the clamp arm is inserted through a clamp hole of the shutter. Then, when the clamp arm moves inside the body in the axial direction and rotates, the shutter moves integrally with the clamp arm in the axial direction to cover the slit hole. Thus, the opening portion of the slit hole is suitably covered except that portion occupied by the claw portion so that foreign matter and the like can be prevented from entering the locating section through the slit hole.

6 Claims, 7 Drawing Sheets

(58) Field of Classification Search
CPC ..... B25B 5/122; B23Q 3/082; B23Q 3/06; B23Q 3/069; B23Q 11/08
USPC ..... 269/24–27, 32, 201, 236, 238, 229
See application file for complete search history.

(56) References Cited

U.S. PATENT DOCUMENTS

| | | | | |
|---|---|---|---|---|
| 8,256,755 | B2 * | 9/2012 | Hiromatsu | B25B 5/087 269/238 |
| 10,124,469 | B2 * | 11/2018 | Yoshimura | B25B 5/061 |
| 2004/0041323 | A1 * | 3/2004 | Migliori | B25B 5/16 269/32 |
| 2005/0017423 | A1 * | 1/2005 | Kita | B25B 5/087 269/32 |
| 2008/0230973 | A1 * | 9/2008 | Miyazaki | B25B 5/087 269/309 |

FOREIGN PATENT DOCUMENTS

| | | | |
|---|---|---|---|
| EP | 2 130 643 | A1 | 12/2009 |
| JP | 3941059 | B2 | 7/2007 |
| JP | 2010-173024 | A | 8/2010 |

OTHER PUBLICATIONS

Indian Office Action dated Feb. 24, 2021 in Indian Patent Application No. 202047023989 (with English translation), 6 pages.

* cited by examiner

CLAMPING DEVICE

TECHNICAL FIELD

The present invention relates to a clamping device capable of clamping a workpiece with a clamp arm that is pivotable a predetermined angle under a driving action of a drive section.

BACKGROUND ART

The present applicant has proposed a clamping device for clamping components of, for example, a motor car or the like when the components are welded (refer to Japanese Patent No. 3941059).

The clamping device includes a clamp body and a workpiece receiving member provided on an upper portion of the clamp body, and a hollow locating pin protruding upward is provided at a center portion of the upper end portion of the workpiece receiving member. A clamp arm is movably inserted inside the locating pin, and a distal end portion of the clamp arm is configured to protrude outside from a clamp hole which opens on a lateral side of the locating pin.

On the other hand, a lower portion of the clamp body is connected to a linear actuator, and an output member of the linear actuator is inserted into the clamp body and is connected at its end portion to the clamp arm mutually swingably with a connecting pin.

Then, when pressurized fluid is supplied to the linear actuator, the output member is moved in the axial direction, whereby the clamp arm swings inside the clamp body, the workpiece receiving member, and the locating pin. As a result, a hook-like end portion formed at an upper end portion of the clamp arm protrudes outside through the clamp hole of the locating pin and clamps a workpiece mounted on a seating surface of the workpiece receiving member. In this clamping state, welding is performed.

SUMMARY OF INVENTION

A general object of the present invention is to provide a clamping device capable of reliably preventing foreign matter and the like from entering the inside of a body.

In one aspect, according to the present invention, there is provided a clamping device which comprises a drive section having a displacement body movable in an axial direction under an action of supplying pressurized fluid, a body connected to the drive section and having a mounting portion on which a workpiece is mounted, a clamp arm connected to the displacement body and pivotably supported relative to the body, a locating section protruding in the axial direction relative to the mounting portion and being inserted into a positioning hole formed in the workpiece, wherein a linear motion of the displacement body outputted by the drive section is converted into a pivotal motion of the clamp arm, a slit hole is formed in the locating section and opens along the axial direction, a claw portion of the clamp arm housed inside the locating section protrudes through the slit hole, the workpiece is clamped between the mounting portion and the claw portion. In the clamping device, a cover member that faces the slit hole and is movable in the axial direction is provided inside the locating section, and the cover member is provided with an opening into which the claw portion is inserted, the opening faces the slit hole.

According to the present invention, when the workpiece that is mounted on the mounting portion and through which the locating section is inserted is clamped by the clamp arm, the clamp arm is moved in the axial direction inside the body and the locating section under the action of the drive section. Thus, because the cover member is moved integrally with the clamp arm while covering the slit hole, the opening portion of the slit hole is reliably covered. Therefore, even when the claw portion protrudes outside from the slit hole through the opening and clamps the workpiece, the opening portion of the slit hole except that portion occupied by the claw portion is completely covered by the cover member.

Consequently, foreign matter such as spatters and the like which are produced in performing, for example, a welding work with the workpiece clamped by the clamp arm can reliably be prevented by the cover member from entering the inside of the locating section and the body.

The above and other objects, features and advantages of the present invention will become more apparent from the following description when taken in conjunction with the accompanying drawings, in which a preferred embodiment and modifications of the present invention are shown by way of illustrative examples.

DESCRIPTION OF EMBODIMENTS

Figure 1:
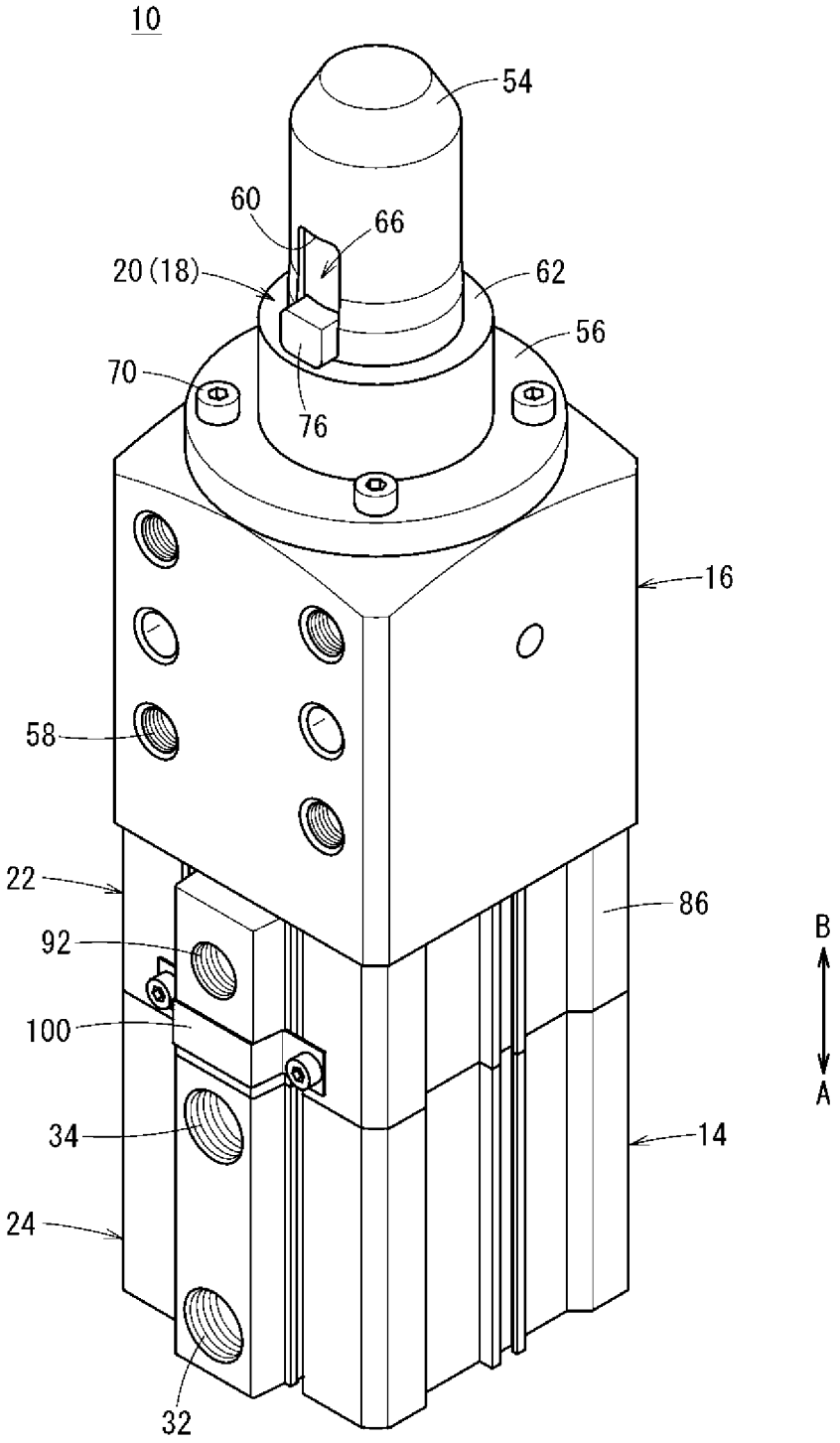
FIG. 1 is a perspective view of a clamping device in one embodiment according to the present invention.
Figure 2:
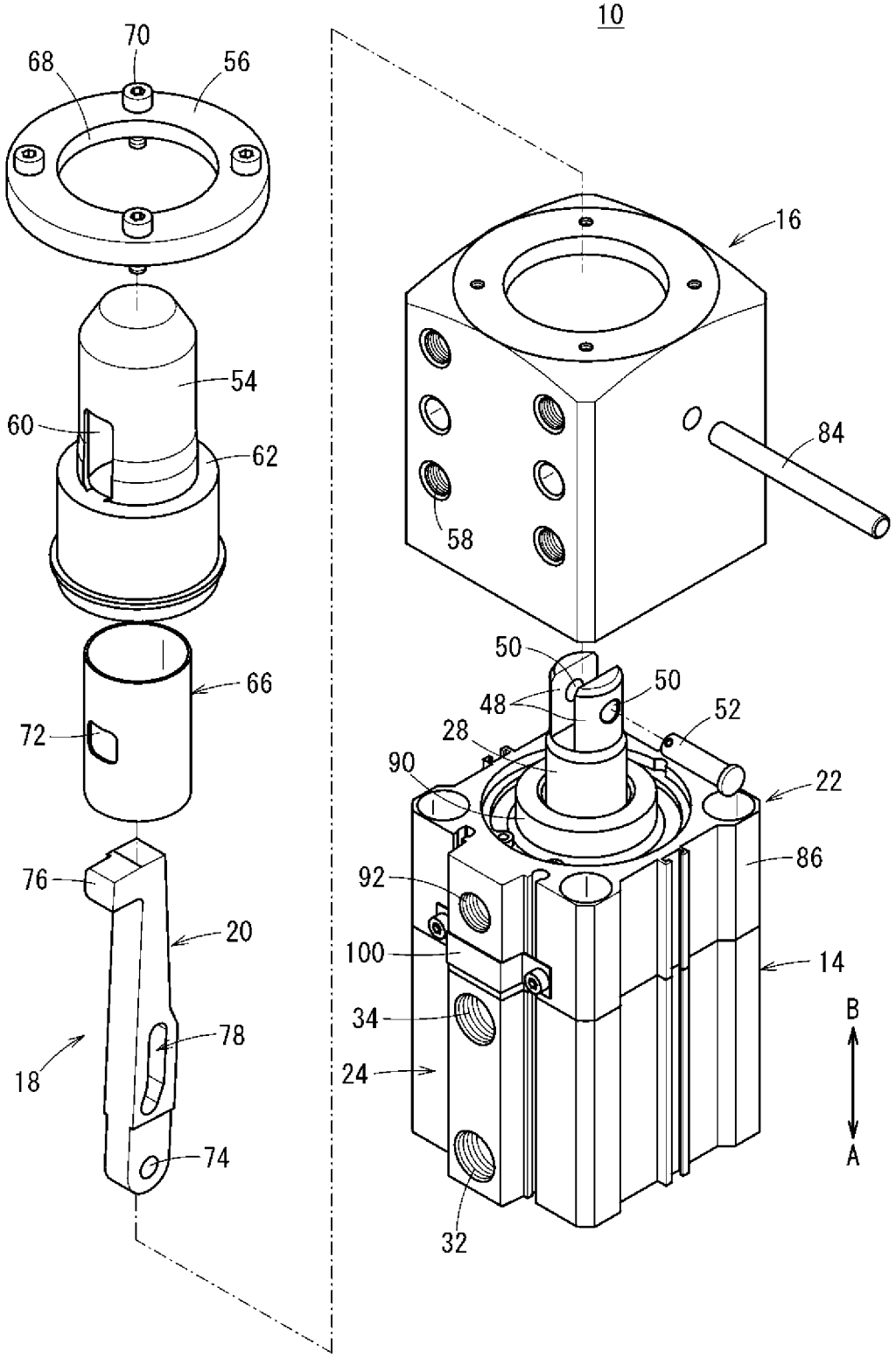
FIG. 2 is a perspective view in a disassembled state of the clamping device shown in FIG. 1.

As shown in FIGS. 1 to 5, a clamping device 10 includes a cylinder section 14 having a piston (displacement body) 12 displaced under an action of supplying pressurized fluid (for example, compressed air), a hollow cylindrical body 16 connected to the cylinder section 14, a clamp section 18 provided swingably inside the body 16 and being capable of holding workpieces W1, W2 (refer to FIGS. 4 and 5), and a lock switching mechanism (lock mechanism) 22 provided between the cylinder section 14 and the body 16 and being capable of restricting movements of a clamp arm 20.

Incidentally, the aforementioned clamping device 10 is used, for example, to hold, as the workpieces W1, W2, plate materials that are used for automotive panels and in this way is used in a manufacturing line where one workpiece W1 and another workpiece W2 are welded.

The cylinder section 14 includes a cylinder tube 24, a rod cover 26 connected to an upper end portion of the cylinder tube 24, the piston 12 movably provided inside the cylinder tube 24, and a piston rod (displacement body) 28 connected to the piston 12 and supported movably relative to the rod cover 26.

The cylinder tube 24 is formed as, for example, a bottomed cylinder opening at an upper end portion. Inside the cylinder tube 24, a cylinder chamber 30 with a circular cross section is formed extending in the axial direction (the arrow A-B direction). Outside the cylinder tube 24, a pair of first and second fluid ports 32, 34 is formed into which pressurized fluid is supplied and from which the pressurized fluid is discharged.

The first and second fluid ports 32, 34 are connected to a pressurized fluid supply (not shown) through tubes and switch valves (not shown), are formed a predetermined distance apart from each other in the axial direction of the cylinder tube 24, and are in communication with the cylinder chamber 30 through communication passages 36.

Incidentally, the first fluid port 32 is provided on a lower side (the arrow A direction) of the body 16, while the second fluid port 34 is provided on an upper side (the arrow B direction) of the body 16.

The rod cover 26 is formed to have a circular cross section, and a rod hole 38 into which the piston rod 28 is inserted perforates the rod cover 26 at a central portion thereof. A rod packing 40 provided inside the rod cover 26 slidably contacts an outer peripheral surface of the piston rod 28. The rod cover 26 is fitted in the cylinder tube 24 closing the opening upper end portion of the cylinder tube 24.

The piston 12 has a cylindrical cross section and is provided movably along the cylinder chamber 30. The piston rod 28 is inserted into a central portion of the piston 12 along the axial direction and is connected to the piston 12. A piston packing 42, a wear ring 44, and a magnet 46 are fitted in annular grooves formed on the outer peripheral surface of the piston 12.

The piston rod 28 comprises a shaft body having a circular cross section and extends a predetermined length toward the body 16 side (the arrow B direction) with respect to the piston 12. The piston rod 28 is inserted into the rod hole 38 of the rod cover 26 and is supported being slidable along the axial direction (the arrow A-B direction).

Further, an arm holding portion 48 being bifurcated is formed at an upper end portion on the body 16 side of the piston rod 28. The arm holding portion 48 is connected to one end portion of the clamp arm 20 with a connecting pin 52 which is inserted into a first pin hole 50 extending through the arm holding portion 48 in a direction perpendicular to the longitudinal direction.

Incidentally, the piston rod 28 is accommodated extending from the cylinder section 14 to the inside of the body 16 through the lock switching mechanism 22.

The body 16 is formed of, for example, a metal material and is provided coaxially with the cylinder section 14 through the lock switching mechanism 22. The clamp arm 20 is swingably housed inside the body 16, and a locating section 54 is mounted on an upper portion of the body 16 with a holder 56 in between.

In the lateral surface of the body 16, mounting holes 58 (refer to FIGS. 1 and 2) for fixing the clamping device 10 in the manufacturing line are formed.

The locating section 54 has a cylindrical shape extending in the axial direction and is provided at its lateral surface with a slit hole 60 through which a portion of the clamp arm 20 is able to protrude outside. This slit hole 60 is formed long and straight to have a predetermined length along the axial direction (the arrow A-B direction) of the locating section 54.

Figure 4:
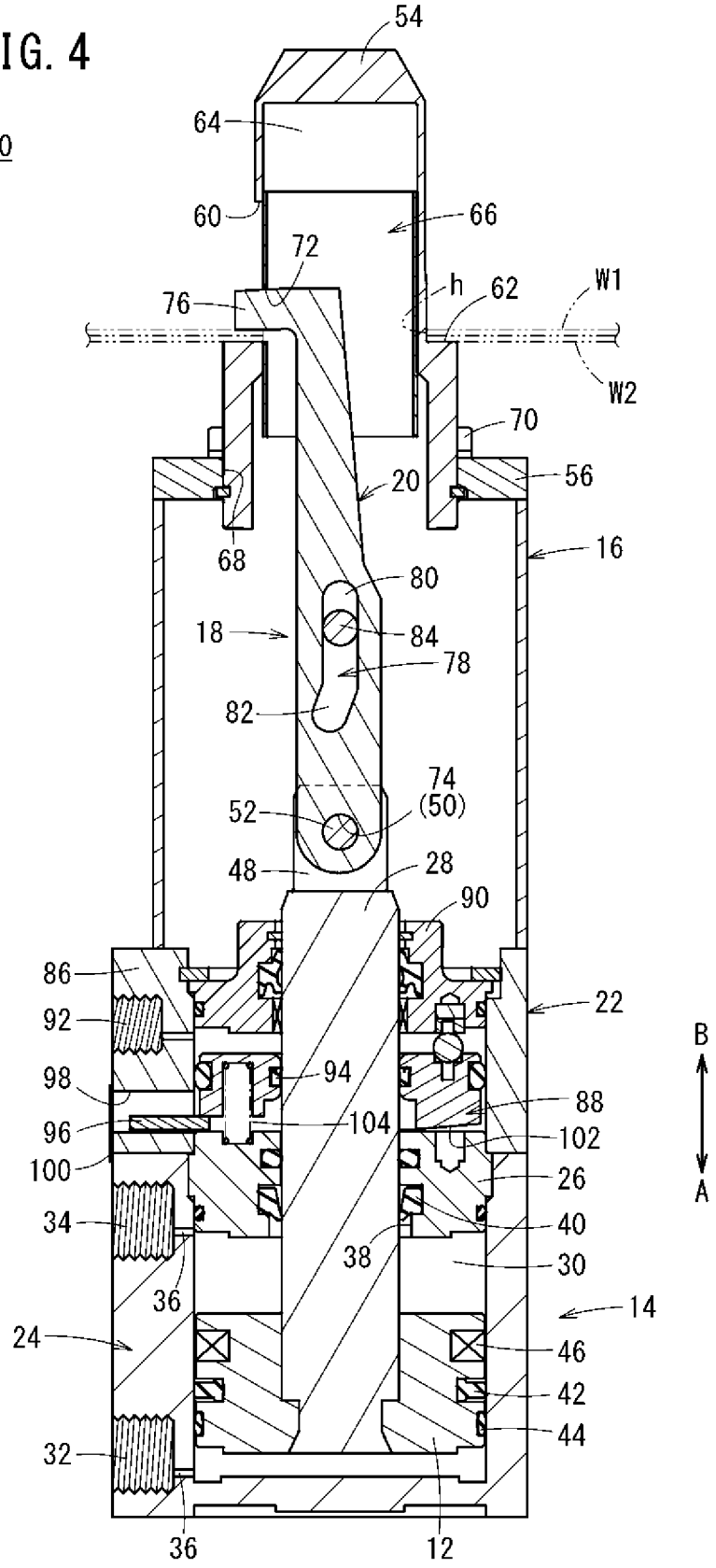
FIG. 4 is a sectional view taken along line IV-IV in FIG. 3.
Figure 5:
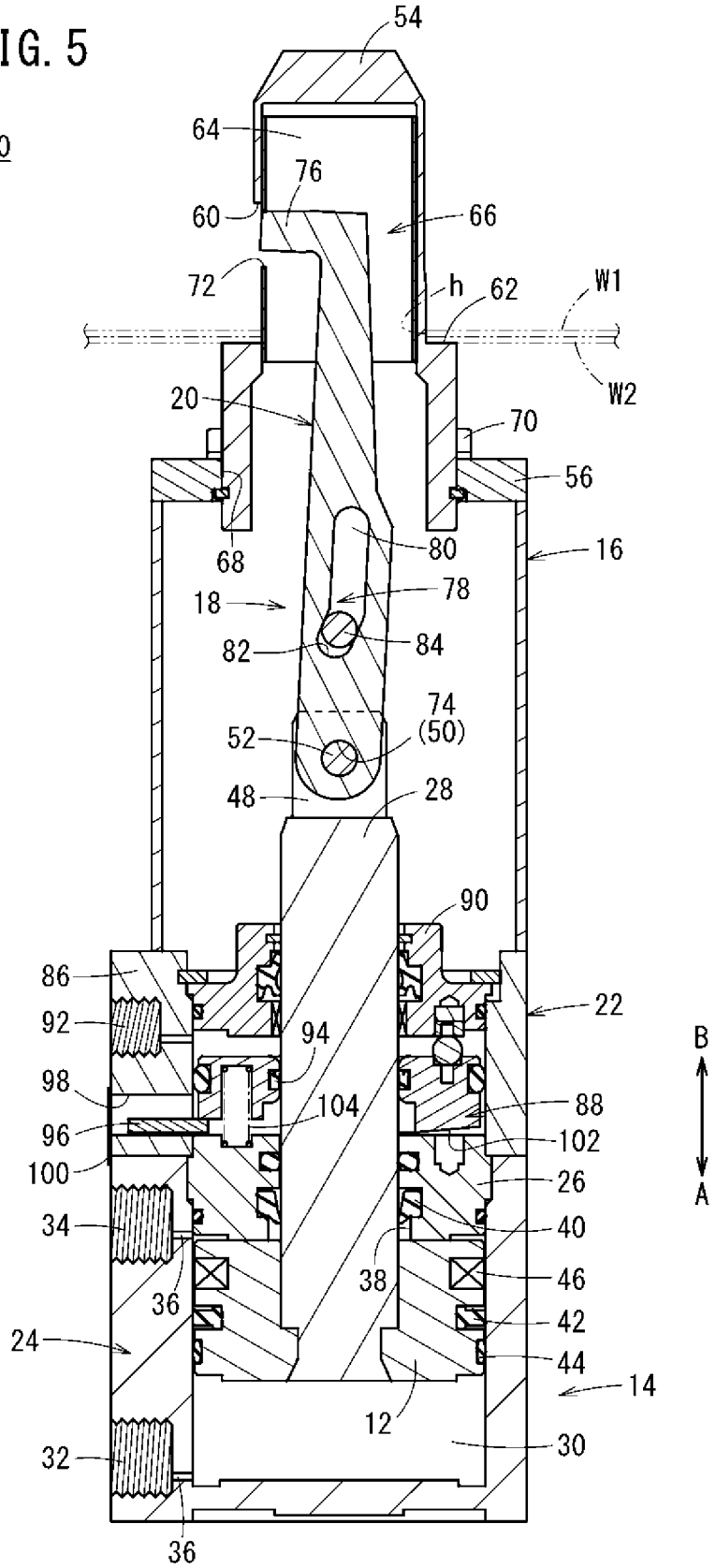
FIG. 5 is an entire sectional view of the clamping device shown in FIG. 4 in an unclamping state.

Further, the locating section 54 has an annular mounting portion 62 which expands radially outward and is provided in the vicinity of an intermediate portion in the axial direction, and this mounting portion 62 is planar-shaped substantially perpendicular to the axis of the locating section 54. Then, as shown in FIGS. 4 and 5, when the locating section 54 is inserted into positioning holes h of the workpieces W1, W2, the workpieces W1, W2 are held in a substantially horizontal position by abutment on the mounting portion 62.

On the other hand, inside the locating section 54, a chamber 64 having a circular cross section is formed extending in the axial direction and is in communication with the outside through the slit hole 60. Also inside the locating section 54, a cylindrical shutter (cover member) 66 is provided movably along the axial direction (the arrow A-B direction).

Then, the locating section 54 is fixed with its lower end portion fitted in a holder hole 68 of the holder 56 formed in a plate shape, and the holder 56 is fixed by plural bolts 70 to the body 16 covering an upper end portion of the body 16. Thus, the locating section 54 is provided to protrude a predetermined height upward (in the arrow B direction) with respect to the upper end portion of the body 16.

The shutter 66 is cylindrically formed of, for example, a metal material and is at least longer along the axial direction (the arrow A-B direction) than the longitudinal dimension of the slit hole 60 in the locating section 54 and to be substantially the same as, or slightly smaller than, an inner peripheral diameter of the locating section 54.

Further, in an outer peripheral surface of the shutter 66, a clamp hole (opening) 72 is formed through the shutter 66 in the radial direction. The clamp hole 72 is formed at a substantially center portion in the axial direction (the arrow A-B direction) of the shutter 66 and has a rectangular cross section which is made up of two sides extending in the axial direction of the shutter 66 and two sides extending in a direction perpendicular to the axial direction.

Then, the shutter 66 is disposed so that the clamp hole 72 faces the slit hole 60. The other end portion of the clamp arm 20, details of which will be described later, is inserted inside the shutter 66, and a claw portion 76 of the clamp arm 20, which is also described later, is inserted into the clamp hole 72.

The clamp section 18 has a long clamp arm 20 formed of a metal material and housed inside the body 16. One end of the clamp arm 20 is inserted into a space between the bifurcated portions of the arm holding portion 48 of the piston rod 28 and is pivotably connected to the arm holding portion 48 because the connecting pin 52 inserted into the first pin hole 50 of the piston rod 28 is inserted through a second pin hole 74. That is, the clamp arm 20 is pivotable about one (i.e., lower) end portion into which the connecting pin 52 is inserted.

Further, the other end portion side of the clamp arm 20 is housed inside the shutter 66 and the locating section 54, and the other end portion is provided with a hook-like claw portion 76 which is bent at right angle relative to the longitudinal direction of the clamp arm 20. The claw portion 76 is formed to laterally protrude a predetermined length relative to the other end portion of the clamp arm 20, is inserted into the clamp hole 72 of the shutter 66 and is also inserted into the slit hole 60 of the locating section 54.

Furthermore, the clamp arm 20 is provided with a link groove 78 at a substantially center portion in the longitudinal direction thereof, and the link groove 78 is constituted by a first groove portion 80 extending substantially in parallel to the longitudinal direction of the clamp arm 20 and a second groove portion 82 joined with a lower side (in the arrow A direction) of the first groove portion 80 and bent at a predetermined angle. As the link groove 78 extends downward, the second groove portion 82 slants to gradually come close to a lateral side of the cylinder section 14. On the lateral side, the first and second fluid ports 32, 34 open.

Further, a link pin 84 supported by sidewalls of the body 16 is inserted into the link groove 78 with the clamp arm 20 housed inside the body 16.

The lock switching mechanism 22 has a housing 86, a lock ring (lock member) 88 housed inside the housing 86, and an end block 90 closing an upper end portion of the housing 86, and a lock release port 92 opens on a side surface of the housing 86. The lock release port 92 is in communication with the inside of the housing 86.

The housing 86 is formed in a hollow shape and is provided between the upper end portion of the cylinder section 14 and the lower end portion of the body 16 being coupled to both. The lock release port 92 opens in the same direction as the first and second fluid ports 32, 34, and is connected to the pressurized fluid supply (not shown) through, for example, tubes and switch valves (both not shown).

The lock ring 88 is, for example, annular-shaped and is provided tiltably inside the housing 86. The piston rod 28 is inserted into a lock hole 94 that extends through the center of the lock ring 88. The lock hole 94 has a diameter that is slightly larger than the outer diameter of the piston rod 28.

Further, a plate-like release lever 96 is provided on one end (i.e., lower end) surface of the lock ring 88. The release lever protrudes in the radial direction. A distal end of the release lever 96 is inserted into a working hole 98 that opens on a sidewall of the housing 86. Incidentally, the working hole 98 is covered by a cover 100 which is detachably attached to the sidewall of the housing 86.

Furthermore, a taper portion 102 constituted by a tapering surface on one end surface of the lock ring 88 is formed and is apart from the end surface of the rod cover 26. The taper portion 102 can be tilted slightly towards the rod cover 26 side.

Figure 6:
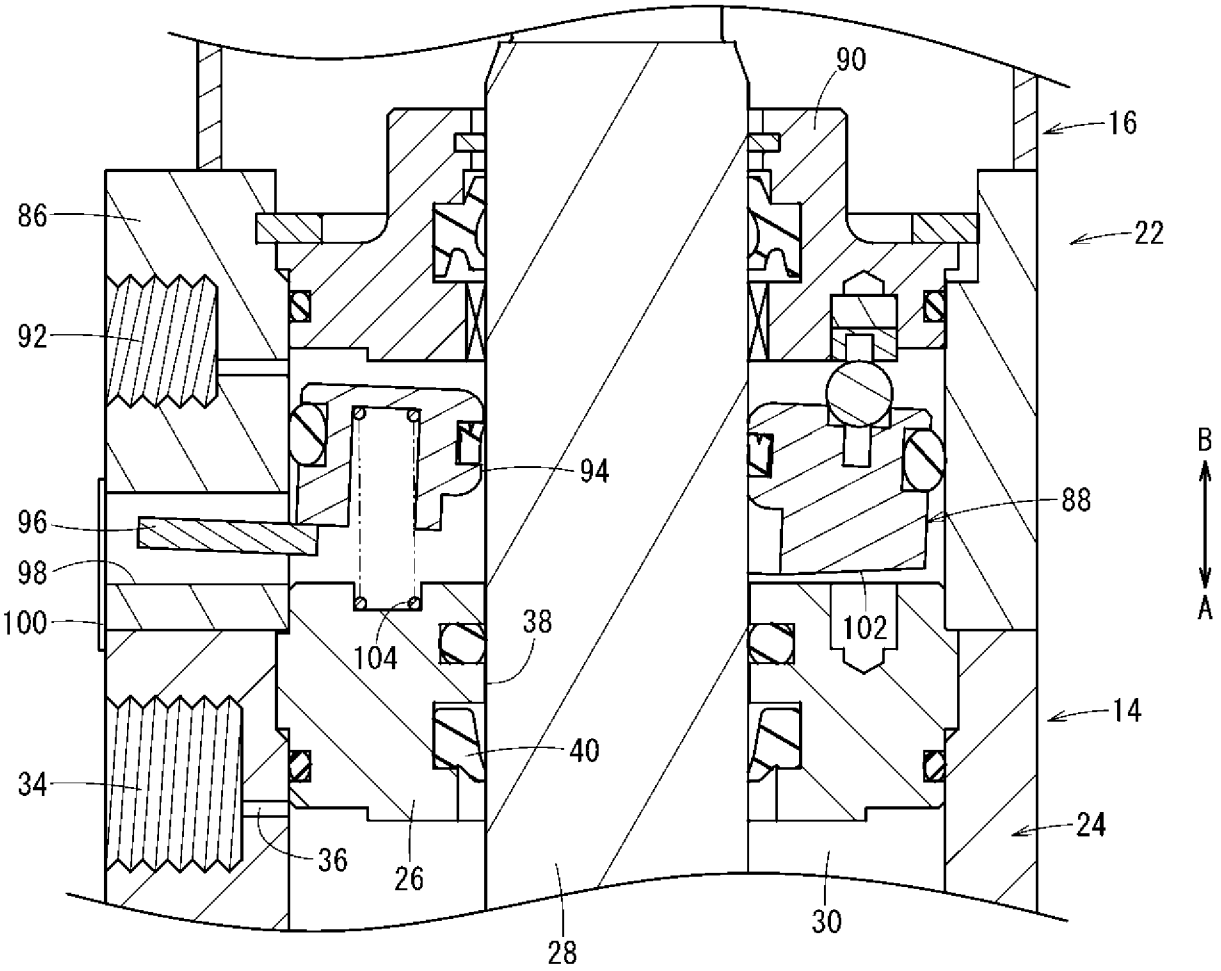
FIG. 6 is an enlarged sectional view of a locked state of a clamp arm under a lock switching mechanism shown in FIGS. 4 and 5.

A return spring (resilient member) 104 is provided between the lock ring 88 and the rod cover 26 on a side opposite to the taper portion 102. As shown in FIG. 6, the lock ring 88 is urged and tilted by the resilient force of the return spring 104 in the same direction as the release lever 96 separates from the rod cover 26. Thus, tilted by the resilient force of the return spring 104, the lock ring 88 is brought into abutment on the piston rod 28 that has been inserted into the lock hole 94, whereby the piston rod 28 is put in a lock state where movement is restricted by the resistance caused by the abutment.

Further, when pressurized fluid is supplied from the lock release port 92 into the inside of the housing 86, the lock ring 88 is pressed and tilted in the opposite direction against the resilient force of the return spring 104 thereby to be in a horizontal position. As a result, the piston rod 28 is released from the lock state caused by the lock ring 88 and brought into a lock released state in which the piston rod 28 is movable in the axial direction.

Furthermore, even in the case where it is unable to supply the lock release port 92 with pressurized fluid, a worker (not illustrated) detaches the cover 100 and pushes the release lever 96 down toward the cylinder section 14 side (the arrowed A direction) through the working hole 98, whereby the lock ring 88 is brought into a substantially horizontal position and it becomes possible to manually release the lock state of the piston rod 28.

The clamping device 10 according the embodiment of the present invention is basically configured as described hereinabove, and the operation and advantageous effects of the clamping device 10 will be described hereunder. Incidentally, the operation will be described on the assumption that an unclamping state shown in FIG. 5 is an initial state.

In this initial state, as shown in FIG. 5, pressurized fluid has been supplied to the cylinder chamber 30 of the cylinder tube 24 from the first fluid port 32, while the second fluid port 34 is in a state of being open to the atmosphere. Therefore, the piston 12 has been moved upward (the arrowed B direction) under the pressing action of pressurized fluid and is abutting the end surface of the rod cover 26. Further, the clamp arm 20 has been pivoted by the elevation of the piston rod 28, so that the claw portion 76 has been retracted inside the locating section 54 of the body 16.

In the aforementioned initial state of the clamping device 10, the workpieces W1, W2 are transferred by a transfer equipment or the like (not shown), the locating section 54 is inserted into the positioning holes h of the workpieces W1, W2. Thus, one workpiece W1 and the other workpiece W2 are mounted such that one is put on the other on the upper surface of the mounting portion 62 of the body 16 and are held in a substantially horizontal position.

In this case, as shown in FIG. 5, the claw portion 76 of the clamp arm 20 is housed in the locating section 54 and does not protrude outwards through the slit hole 60 and thus is able to avoid the contact with the workpieces W1, W2, so that the workpieces W1, W2 can be smoothly moved to and placed on the mounting portion 62.

After the confirmation of the placing of the workpieces W1, W2, the pressurized fluid from the pressurized fluid supply is supplied to the second fluid port 34 instead of the first fluid port 32 by the switching action of the switching valve (not shown). As a result, the piston 12 begins to move downward and this causes the clamp arm 20 connected to the piston rod 28 to become pivotable. By the pressurized fluid supplied from the second fluid port 34, the piston 12 and the piston rod 28 are moved downward along the axial direction.

Thus, the clamp arm 20 is lowered, whereby the claw portion 76 is lowered along the slit hole 60 and further the shutter 66 having the claw portion 76 inserted into the clamp hole 72 is lowered together. At the same time, the link pin 84 begins to be relatively moved from the second groove portion 82 of the link groove 78 to the first groove portion 80. The clamp arm 20 is pivoted counterclockwise about the connecting pin 52, and together with this pivot movement, the claw portion 76 starts to protrude outside the slit hole 60 through the clamp hole 72.

As a result, as shown in FIG. 4, the claw portion 76 of the clamp arm 20 sticks out of the locating section 54 and is brought into abutment on the upper surface of the workpiece W1 mounted together with the workpiece W2 on the mounting portion 62, pressing the workpiece W1 downwards, whereby the workpieces W1, W2 are clamped in a substantially horizontal position between the mounting portion 62 and the clamp arm 20.

Further, when the supply of pressurized fluid to the lock release port 92 is stopped in this clamping state of the workpieces W1, W2, the lock ring 88 is tilted by the resilient force of the return spring 104 as shown in FIG. 6 and is tilted relative to the piston rod 28 to be brought into contact with the piston rod 28 through the lock hole 94, whereby the pivotal movement of the clamp arm 20 is locked in the state where the workpieces W1, W2 are clamped.

That is, even in the case where the supply of the pressurized fluid to the second fluid port 34 is stopped, the state of clamping the workpieces W1, W2 with the clamp arm 20 is reliably kept by the lock switching mechanism 22.

Figure 3:
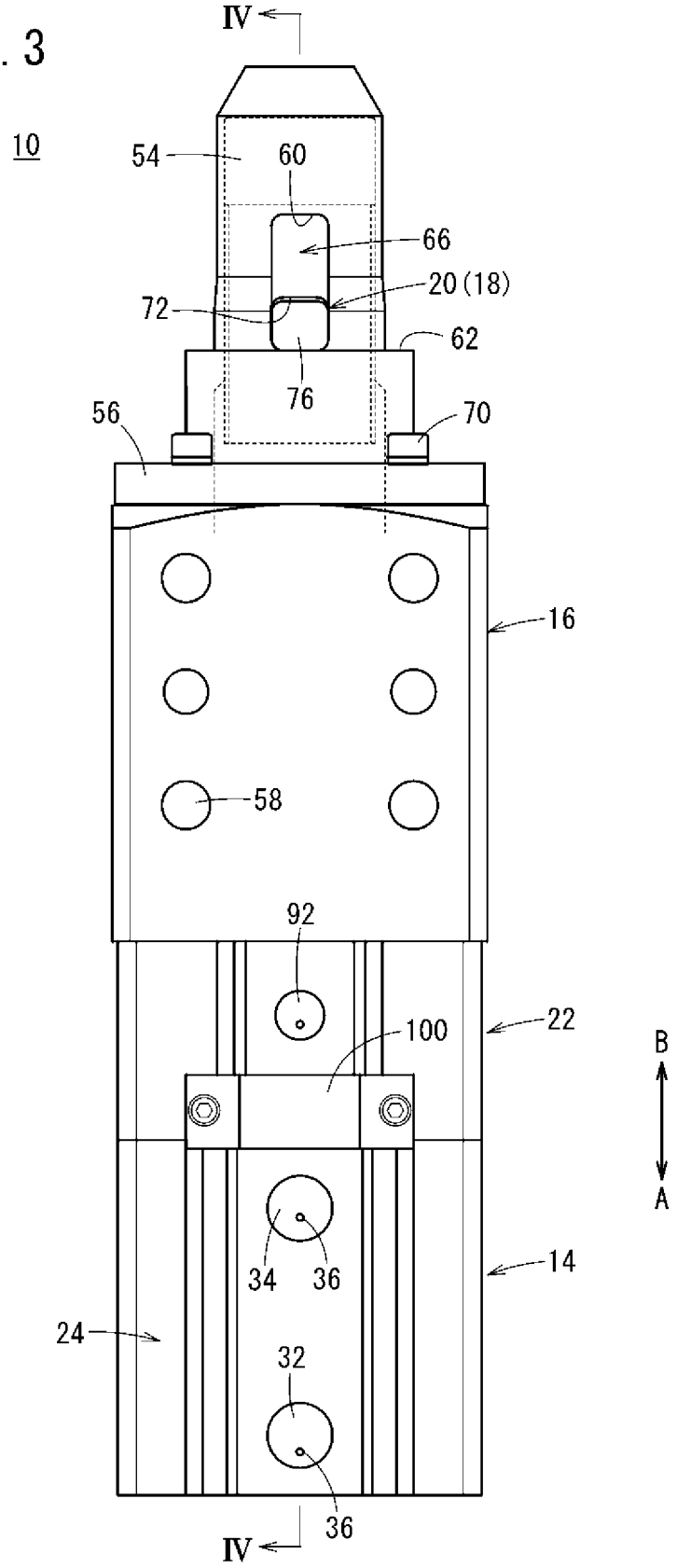
FIG. 3 is a front view of the clamping device shown in FIG. 1.

Thereafter, in the clamping state where the workpieces W1, W2 are clamped at a predetermined position by the clamping device 10 as described above, the welding operation of one workpiece W1 and the other workpiece W2 is performed by a welding apparatus (not shown). At this time, as shown in FIGS. 3 and 4, part of the slit hole 60 is covered by the outer peripheral surface of the shutter 66 provided inside the slit hole 60, that part not being a portion occupied by the claw portion 76 protruding outside. Accordingly, spatters and the like produced at the time of welding can be prevented from entering inside through the slit hole 60.

Next, description will be given regarding the case that the clamping state of the workpieces W1, W2 is released (the unclamping state) after the completion of the welding operation of the workpieces W1, W2.

In the clamping device 10 shown in FIG. 4, pressurized fluid is supplied to the lock release port 92 to release the lock state of the clamp arm 20, and together with this, pressurized fluid is supplied from the first fluid port 32 to the cylinder chamber 30. As a result, the piston 12 and the piston rod 28 move upward (the arrow B direction) and the clamp arm 20 moves upward while being pivoted.

Because the link pin 84 moves from the first groove portion 80 to the second groove portion 82 of the link groove 78, the clamp arm 20 pivots clockwise about the connecting pin 52, whereby the claw portion 76 is retracted inside the locating section 54.

At the same time, together with the elevation of the clamp arm 20, the shutter 66 through which the claw portion 76 is inserted is also elevated together.

Then, when the piston 12 is moved to a position where the piston 12 abuts the rod cover 26 as shown in FIG. 5, the claw portion 76 is completely retracted inside the locating section 54 through the slit hole 60 while being kept inserted into the clamp hole 72 of the shutter 66, whereby the state transitions into the unclamping state where the state of the workpieces W1, W2 being clamped by the claw portion 76 is released. Incidentally, when in this unclamping state, the device is also in the lock release state where the pressurized fluid is continuously supplied to the lock release port 92.

As described above, in the present embodiment, the clamp arm 20 is pivotably housed inside the body 16 that is part of the clamping device 10, the locating section 54 provided at the upper end portion of the body 16 is provided with the shutter 66 which is movable vertically (the arrow A-B direction) together with the clamp arm 20, and the shutter 66 formed in the cylindrical shape is provided to face the slit hole 60 of the locating section 54 through which the claw portion 76 of the clamp arm 20 protrudes outside.

Then, the claw portion 76 of the clamp arm 20 is able to move vertically along the slit hole 60 under the drive action of the cylinder section 14, and the shutter 66 movable together with the claw portion 76 is able to reliably close the opening portion of the slit hole 60 except the area occupied by the claw portion 76 even when the claw portion 76 protrudes beyond the slit hole 60 and clamps the workpieces W1, W2.

As a result, for example, it can be reliably prevented by the shutter 66 for foreign matter such as spatters and the like which are produced in performing the welding of the workpieces W1, W2 clamped by the clamp arm 20 to enter the inside of the body 16 through the slit hole 60.

Further, by keeping the claw portion 76 of the clamp arm 20 always inserted into the clamp hole 72 of the shutter 66, it is possible to move the shutter 66 integrally with the vertical movement of the clamp arm 20.

Furthermore, by providing between the cylinder section 14 and the body 16 the lock switching mechanism 22 which is able to lock the operation of the clamp arm 20, it is possible for the lock switching mechanism 22 to reliably and stably maintain the clamping state where the workpieces W1, W2 are clamped by the clamp arm 20, even when the supply of pressurized fluid to the cylinder section 14 is stopped.

Still furthermore, the lock ring 88 being part of the lock switching mechanism 22 is provided with the release lever 96 operable from outside the housing 86. Thus, even in the case where the lock state of the piston rod 28 by the lock ring 88 cannot be released because the supply of pressurized fluid to the lock release port 92 of the housing 86 stops, the worker can manually release the lock state by pressing the release lever 96 down to forcibly tilt the lock ring 88.

Further, the shutter 66 is not limited to the cylindrical one having the constant diameter as described above, and instead, there may be used, for example, any one of shutters (cover members) 120, 130, 140, 150, 160 according to first to sixth modifications shown in FIGS. 7A to 7F.

Figure 7A:
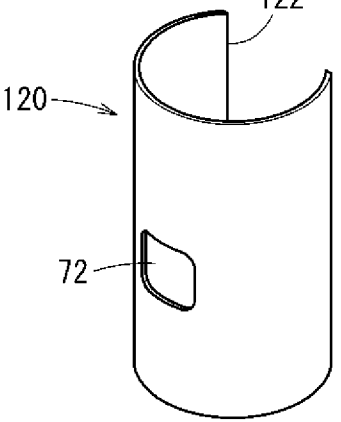
FIGS. 7A to 7F are perspective views of shutters in first to sixth modifications according to the present invention.

First of all, as shown in FIG. 7A, a shutter 120 according to a first modification is formed of a metal material being elastically deformable in the radial direction and is formed in a C-shape in cross section by being cut out at a portion on a side opposite to a clamp hole 72. A cutout portion 122 is formed at a predetermined area along the circumferential direction and extends in the axial direction (the arrow A-B direction). The shutter 120 is fitted in the chamber 64 of the locating section 54 while pressed radially inward and reduced in diameter.

That is, in the shutter 120 according to the first modification, since the portion diametrically opposite to the clamp hole 72 is cut out, it is possible to improve insertability in inserting the other end portion of the clamp arm 20 inside the shutter 66 and to reduce an area contacting with the clamp arm 20 by the provision of the cutout portion 122. This makes it possible, for example, to increase the dimension of the clamp arm and to increase the degre of freedom in design.

Figure 7B:
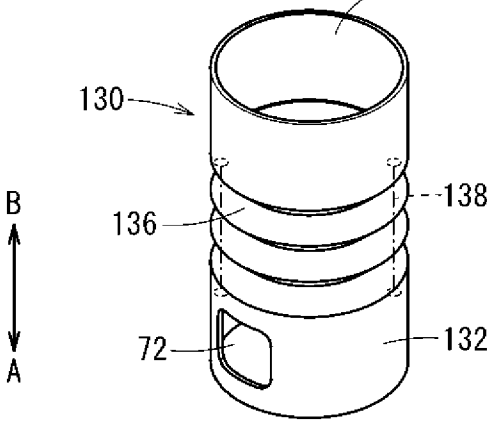

In a shutter 130 according to a second modification, as shown in FIG. 7B, there is provided a bellows portion 136 which connects a main body portion 132 having a clamp hole 72 to an upper end portion 134, and the bellows portion 136 is formed of, for example, an incombustible resin material and is provided expansibly in the axial direction (the arrow A-B direction). Further, inside the bellows portion 136 a spring 138 is provided urging the main body portion 132 and the upper end portion 134 to separate from each other.

When the shutter 130 goes up together with the clamp arm 20 along the locating section 54, the bellows portion 136 is compressed against the resilient force of the spring 138 upon abutment of the upper end portion 134 on the upper end portion of the chamber 64, so that the length of the shutter 130 in the axial direction (the arrow A-B direction) is shortened.

On the other hand, when the shutter 130 goes down together with the clamp arm 20, the upper end portion 134 moves in the direction away from the locating section 54. As a result, the upper end portion 134 moves away from the main body portion 132 because the bellows portion 136 is expanded by the resilient force of the spring 138, so that the length of the shutter 130 in the axial direction is elongated to cover the slit hole 60 with the bellows portion 136.

That is, in the shutter 130 according to the second modification, because of having the axially expansible bellows portion 136, the longitudinal dimension of the shutter 130 can be shortened when the shutter 130 goes up. Therefore, it is possible to decrease the height dimension of the locating section 54 housing the shutter 130 and hence, to downsize the height dimension of the clamping device 10.

Figure 7C:
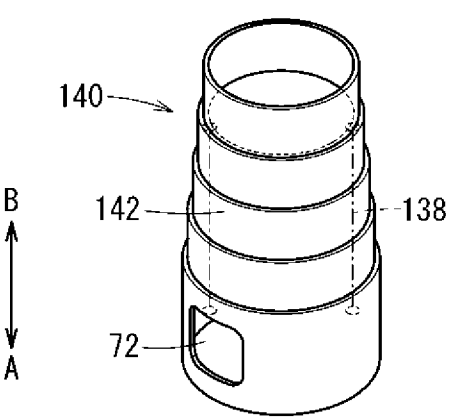
Figure 7D:
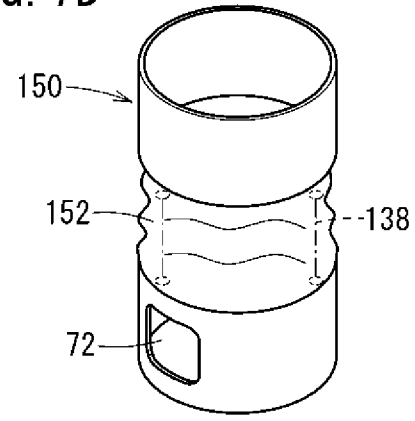

Further, in place of the bellows portion 136 of the shutter 130 in the aforementioned second modification, there may be provided an expansible portion 142 of a telescopic configuration which is expansible in the axial direction like a shutter 140 according to a third modification shown in FIG. 7C. Alternatively, there may be provided a covered portion 152 which is made of a fabric being axially flexible like a shutter 150 according to a fourth modification shown in FIG. 7D. Incidentally, the expansible portion 142 and the covered portion 152 are respectively formed of incombustible resin and fabric.

Even in the shutters 140, 150 according to the third and fourth modifications, it is possible to downsize the longitudinal dimension of each shutter 140, 150 when the shutters go up inside the locating section 54. Accordingly, it becomes possible to decrease the height dimension of the locating section 54 housing the shutter 140 or 150 and hence, to downsize the height dimension of the clamping device 10.

Figure 7E:
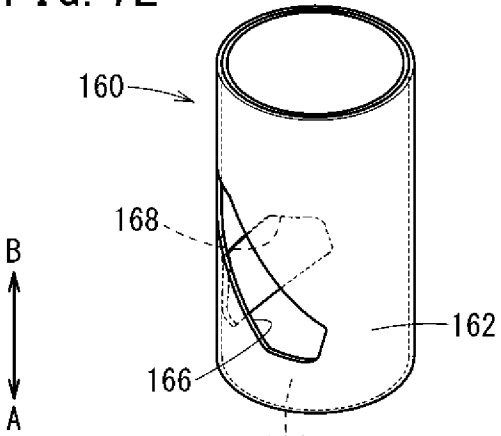

In a shutter 160 according to a fifth modification, as shown in FIG. 7E, the shutter 160 includes a cylindrical outer sleeve 162 and an inner sleeve 164 provided inside the outer sleeve 162. The outer sleeve 162 is formed with a first insertion groove 166 slanted at a predetermined angle with respect to the axis, while the inner sleeve 164 is formed with a second insertion groove 168 slanted at a predetermined angle with respect to the axis and crossing the first insertion groove 166 substantially perpendicularly.

Further, in the shutter 160, the first insertion groove 166 and the second insertion groove 168 intersect each other, and the claw portion 76 of the clamp arm 20 is inserted into both the first and second insertion grooves 166, 168 at the intersection portion.

Thus, for example, when the clamp arm 20 is moved upward for example, the claw portion 76 is moved upward along the first and second insertion grooves 166, 168 while the outer sleeve 162 and the inner sleeve 164 are caused to respectively turn in opposite directions, so that the slit hole 60 is covered by the outer sleeve 162 and the inner sleeve 164.

On the other hand, when the clamp arm 20 is moved downward, the claw portion 76 is moved along the first and second insertion grooves 166, 168 toward respective lower ends thereof. Thus, the outer sleeve 162 and the inner sleeve 164 are reversely turned in opposite directions, so that the slit hole 60 is covered by the outer sleeve 162 and the inner sleeve 164.

That is, in the shutter 160 according to the fifth modification, the outer sleeve 162 and the inner sleeve 164 only turn and are not moved in the vertical direction (the arrow A-B direction). Accordingly, it is possible to decrease the height dimension of the locating section 54 housing the shutter 160 and hence, to downsize the height dimension of the clamping device 10.

Figure 7F:
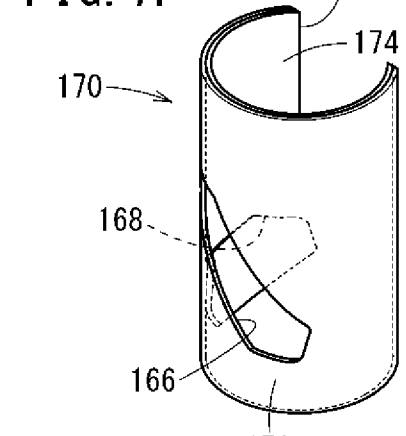

Further, like a shutter 170 according to a sixth modification shown in FIG. 7F, an outer sleeve 172 and an inner sleeve 174 are formed in a C-shape in cross section by being each provided with a cutout portion 176. With this configuration, in addition to an advantage attained by the shutter 160 that the height dimension of the clamping device 10 is downsized by decreasing the height dimension of the locating section 54, it is possible to improve the insertability when the other end portion of the clamp arm 20 is inserted inside the inner sleeve 174 and to enhance the degree of freedom in designing the clamp arm 20.

Obviously, the present invention is not limited to the foregoing embodiment and modifications. It is of course possible that the present invention may take various configurations without departing from the gist of the present invention.

The invention claimed is:

1. A clamping device comprising:

a chive section having a displacement body movable in an axial direction under an action of supplying pressurized fluid;

a body connected to the drive section and having a mounting portion on which a workpiece is mounted;

a clamp arm connected to the displacement body and pivotably supported relative to the body;

a locating section protruding in the axial direction relative to the mounting portion and being inserted into a positioning hole formed in the workpiece;

wherein a linear motion of the displacement body outputted by the drive section is converted into a pivotal motion of the clamp arm, a slit hole is formed in the locating section and opens along the axial direction, a claw portion of the clamp arm housed inside the locating section protrudes through the slit hole, the workpiece is clamped between the mounting portion and the claw portion, a cover member that faces the slit hole and is movable in the axial direction is provided inside the locating section; and the cover member is provided with an opening into which the claw portion is inserted, the opening faces the slit hole.

2. The clamping device according to claim 1, further comprising:

a lock mechanism configured to restrict the pivotal motion of the clamp arm.

3. The clamping device according to claim 2, wherein: the lock mechanism includes a lock member that is tiltable with respect to the axial direction of the displacement body, wherein the lock member restricts a movement of the displacement body when the lock member is tilted.

4. The clamping device according to claim 3, wherein:

the lock member tilts a predetermined angle urged by a resilient member; and when the pressurized fluid is supplied, the lock member returns from a state where the lock member tilts to a state where the displacement body is movable.

5. The clamping device according to claim 1, wherein: the cover member is a C-shape in cross section and is configured to extend in the axial direction.

6. The clamping device according to claim 1, wherein: the cover member is configured to be expansible in the axial direction in which the cover member is moved.

* * * * *